United States Patent [19]

Mouradian

[11] Patent Number: 4,681,009

[45] Date of Patent: Jul. 21, 1987

[54] NECK APPARATUS FOR STRINGED MUSICAL INSTRUMENTS

[76] Inventor: James T. Mouradian, 40 Church St., Winchester, Mass. 01890

[21] Appl. No.: 897,616

[22] Filed: Aug. 18, 1986

[51] Int. Cl.[4] ..... G10D 3/00

[52] U.S. Cl. ..... 84/293; 29/169.5; 29/460

[58] Field of Search ..... 29/169.5, 460; 84/293

[56] References Cited

U.S. PATENT DOCUMENTS

| | | | |
|---|---|---|---|
| 3,143,028 | 8/1964 | Fender | 84/293 |
| 3,416,399 | 12/1968 | Baldoni | 84/293 |
| 3,443,018 | 5/1969 | Krebs | 84/293 |
| 4,074,606 | 2/1978 | Fender | 84/293 |
| 4,192,213 | 3/1980 | Steinberger | 84/293 |
| 4,508,003 | 4/1985 | Smakula | 84/293 |
| 4,528,886 | 7/1985 | Fender | 84/293 |

*Primary Examiner*—Percy W. Echols

*Attorney, Agent, or Firm*—Joseph S. Iandiorio; William E. Noonan

[57] ABSTRACT

An improved neck apparatus for stringed musical instruments including an elongate base and a longitudinal channel disposed in the base. An acoustically inert filler is disposed in and intimately bonded to the inside surface of at least a portion of the channel and an elongate rod assembly is suspended in the filler. A method is also disclosed for making such a neck apparatus.

23 Claims, 11 Drawing Figures

NECK APPARATUS FOR STRINGED MUSICAL INSTRUMENTS

FIELD OF INVENTION

This invention relates to an improved neck apparatus for guitars and other stringed musical instruments and in particular to a neck apparatus which employs an acoustically inert filler intimately bonded to a channel formed in the neck and further relates to a method of making such a neck apparatus.

BACKGROUND OF INVENTION

When the strings in a conventional stringed musical instrument such as an electric guitar are tightened the neck of the instrument tends to bow slightly. To counteract this string tension a number of techniques have been employed. For example, an adjustable truss rod inserted into the neck may be used to compensate for the string tension and straighten the bowed neck. However, this generates an undesirably large force on the neck and the fret board which it carries. Moreover, in a traditional wood neck guitar the wood may not be equally strong throughout and as a result the neck is not evenly smoothed out by the tightened truss rod.

A further problem which is often encountered in the necks of conventional stringed instruments is the tendency of wooden necks to vibrate at a resonant frequency which is so close to that of the strings that much of the string vibration is dissipated into the neck. As a result of such sympathetic vibrations acoustic quality is distorted and dead spots are exhibited, particularly at low frequencies.

In an attempt to overcome these difficulties a number of guitar necks have recently employed alternative materials such as carbon graphite and forged aluminum and steel. Carbon graphite guitar necks are lightweight and resist bowing when the strings are adjusted. However, such necks lack the feel of natural wood guitar necks and are so stiff that they permit no fine tuning whatsoever. As a result, they are often unsatisfactory for the experienced musician.

Forged necks of aluminum and steel do provide a rigidity and density which resist the unwanted vibrations. However, as with the carbon graphite necks these materials lack the desired feel and fine adjustability of wood necks. Forged necks also exhibit expansion difficulties thus necessitating constant tuning particularly under the heat of stage lights.

An adjustable truss rod has been employed below a dense filler material in the neck. However, because the rod and filler exhibit different coefficients of expansion, as the instrument is used changes in temperature tend to alter curvature of the neck. This can seriously interfere with the use of the instrument.

SUMMARY OF INVENTION

It is therefore an object of this invention to provide an improved neck for stringed musical instruments which greatly reduces sympathetic neck vibrations and dead spots and enhances acoustic quality.

It is a further object of this invention to provide a neck for stringed musical instruments which exhibits uniform strength over the entire neck and bows evenly under string tension.

It is a further object of this invention to provide a neck for stringed musical instruments which exhibits improved rigidity, density and strength but which is also finely adjustable to counteract the string tension.

It is a further object of this invention to provide a neck for stringed musical instruments which maintains an aesthetically pleasing feel while at the same time providing modern uniform acoustic response.

It is a further object of this invention to provide a neck for stringed instruments which remains stable and resists deflection under the widely varying climatic environments which the instrument may encounter.

This invention results from the realization that an improved neck for stringed musical instruments may be provided with improved rigidity and strength and a low flat Q factor for reducing sympathetic neck vibrations and enhancing acoustic quality and, at the same time, with the aesthetically pleasing feel demanded by experienced musicians by employing a substantially uniform channel in the neck which is filled with a filler that intimately bonds to the inside surface of the channel and hardens to achieve a low Q factor and a high rigidity. This invention results from the further realization that such an improved neck may be made finely adjustable by providing at least one adjustable elongate rod within the channel, and that different thermal coefficient of expansion between the rod and filler may be compensated for to eliminate neck distortions by suspending the rod within and not below the filler in the channel.

This invention features an improved neck apparatus for stringed musical instruments which includes an elongate base, a longitudinal channel disposed in the base and an acoustically inert filler disposed in and intimately bonded to the inside surface of at least a portion of the channel. At least one rod assembly is suspended in the filler in the channel.

In a preferred embodiment the at least one elongate rod assembly extends generally centrally through the channel. At least one sleeve may be disposed in the channel for slidably receiving a respective rod assembly. A lubricant may be disposed between the sleeve and the rod assembly for reducing the friction therebetween. In certain embodiments a pair of elongate rods may be disposed in the channel. The rod assembly may include an elongate rod element and an elongate tube may receive the rod element. Means may be provided between the tube and rod to cushion engagement therebetween.

Means may also be provided for adjusting the longitudinal tension of the rod assembly or assemblies within the channel. The means for adjusting may be disposed proximate one end of the channel and attached at one end of the rod and the opposite end of the rod may be fixed within that channel.

The channel may include a substantially uniform cross-section and may have a pair of substantially parallel opposite sides. The channel may include a volume that comprises more than one-half the volume of the base. The base may be composed of a material such as wood or urethane. The filler is typically composed of a material having a hardness (Shore D ASTM D1706 psi) of at least 80 but no greater than 90, a tensile strength (ASTM D638 psi) of at least 3600 but no greater than 6000 and a flexural strength (ASTM D790 psi) of at least 5600 and no greater than 8500.

This invention also features a method for making a neck apparatus for stringed instruments which includes forming a longitudinal channel in an elongate base. At least a portion of the channel is filled with an acoustically inert filler, an elongate rod assembly is suspended in the filler and the filler is allowed to harden and bond intimately to the inside surface of the channel.

The rod assembly may be inserted into a sleeve before being suspended in the filler. A lubricant may be applied to the rod assembly and the inside of the sleeve before the rod assembly is inserted and after it is inserted the sleeve is heat shrunk into intimate engagement with the rod assembly.

DISCLOSURE OF PREFERRED EMBODIMENT

Other objects, features and advantages will occur from the following description of a preferred embodiment and the accompanying drawings, in which.

Figures 1A, 1B:
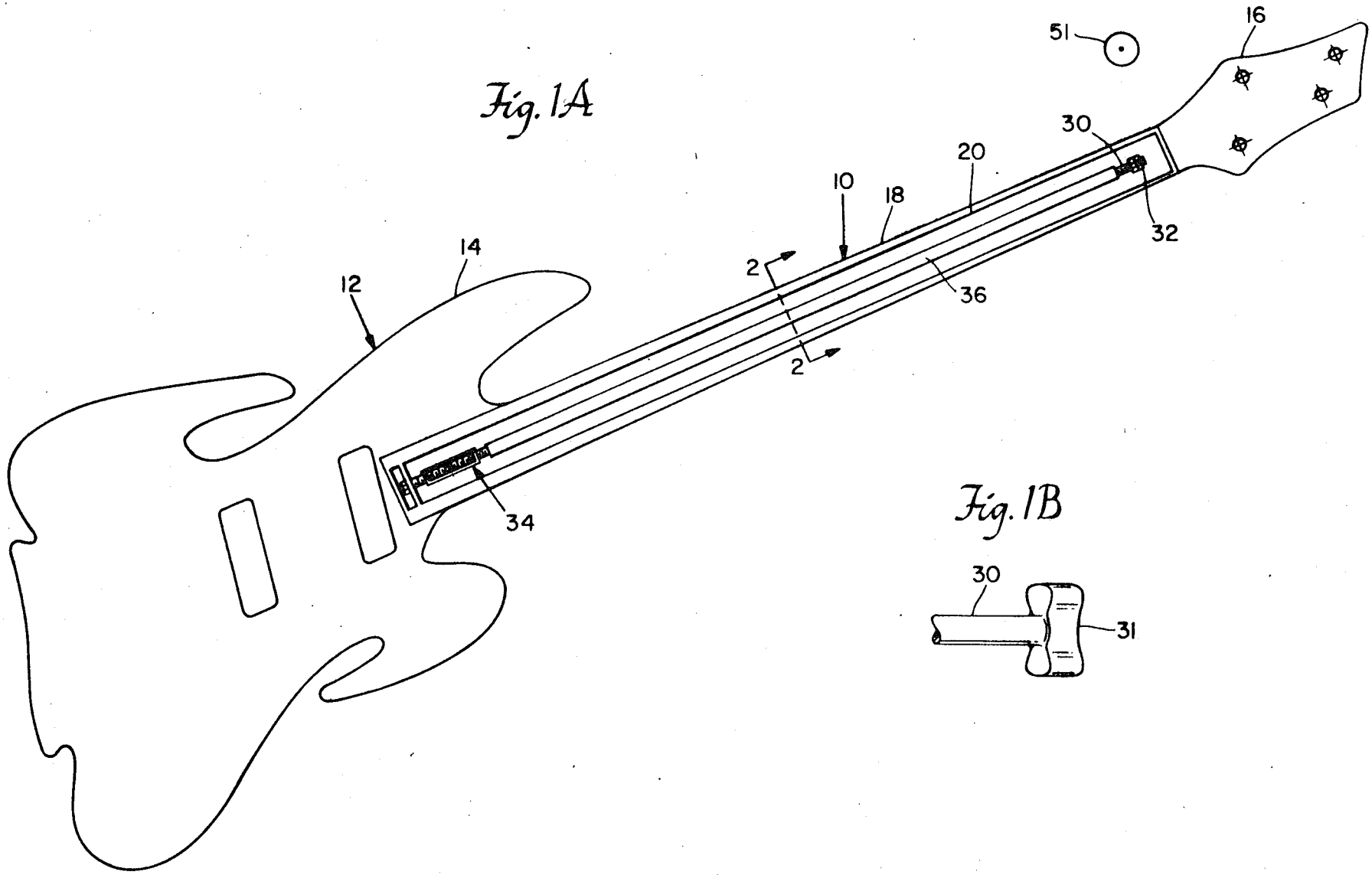
FIG. 1A is a plan view of a guitar employing the neck of this invention with the fret board and strings removed for clarity.
FIG. 1B is an axonometric view of an alternative upper end of the rod assembly of FIG. 1A.

An improved neck apparatus for guitars and other stringed musical instruments according to this invention may be accomplished by employing an elongate base preferably composed of wood, urethane or other material which provides an aesthetically pleasing feel. A longitudinal channel is routed or otherwise formed in the base. The channel is filled with an acoustically inert filler which is intimately bonded to the inside surface of at least a portion of the channel. The filler is typically a liquid epoxy such as F2 liquid aluminum manufactured by Devcon Corp. which hardens to provide a massive, dense insert within the channel. Preferably the filler provides neck rigidity values within the following ranges:

| | | |
|---|---|---|
| Hardness | (Shore D ASTM D1706 psi) | 80-90 |
| Tensile Strength | (ASTM D638 psi) | 3600-6000 |
| Flexural Strength | (ASTM D790 psi) | 5600-8500 |

Such a massive insert substantially elevates the resonant frequency of the neck. This massive insert also serves to damp or "squelch" the lower energy and higher frequency resonances that remain. As a result, sympathetic vibrations of the neck with the strings and unwanted dissipation of the string vibration energy are greatly reduced and the duration of the string vibrations and acoustic quality are correspondingly enhanced.

Typically, the channel includes a substantially uniform cross-section with a pair of substantially parallel opposite sides. To increase the amount of filler within the base and therefore enhance the mass and rigidity of the neck the channel may include a volume that comprises more than one-half the volume of the base, e.g., the channel is formed by removing more than one-half of the original volume of the base.

To further enhance the strength of the neck and to provide the neck with fine adjustability an elongate rod assembly may be disposed in the channel. A preferred rod assembly includes a rod which is $\frac{1}{8}$ to 3/16 inch in diameter and is composed of stainless steel or iron. The rod may be received within an elongate tube comprised of a suitable metal or metal alloy. A plastic or rubber cushion may be provided axially between the tube and rod. The rod assembly should be capable of withstanding approximately 200 pounds of pull generated by the string tension. Before the rod assembly is introduced into the channel it may be wrapped in a sleeve composed of an elastomer such as Teflon TM or PVC which is preferably heat shrunk into intimate engagement with the rod. A lubricant may be applied to at least one of the rod assembly and the inside of the sleeve before the rod assembly is wrapped so that the rod assembly is able to slide longitudinally within the sleeve. The rod assembly typically extends generally centrally in the filler through the channel.

Typically, one end of the rod assembly (e.g., the upper or head end) is fixed within the channel and means are provided proximate the other end of the channel near the guitar body and attached at the other end of the rod assembly for adjusting the longitudinal tension of the rod assembly within the channel. By adjusting longitudinal tension of the rod assembly the musician is able to compensate for the pull on the neck generated by the string tension. The mass and rigidity of the neck provides it with enhanced uniform strength and enables it to bend uniformly under the tension of the strings and the adjusting rod assembly.

Other, alternative rod assemblies may also be employed with good results as long as intimate contact is maintained throughout the length of the channel. For example, a "double reverse" rod may be suspended in the filler. In certain preferred embodiments two or more rod assemblies are disposed in one of the above manners within the channel.

There is shown in FIG. 1A a guitar neck apparatus 10 according to this invention which is employed in a guitar 12. Neck apparatus 10 extends generally between the body 14 and the head 16 of the guitar. The fretboard 17 has been removed for clarity in FIG. 1 but is illustrated along with strings 19 in FIGS. 2.

Figure 2:
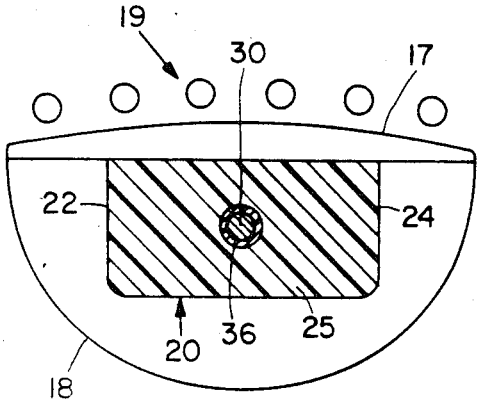
FIG. 2 is a cross-sectional view taken along line 2—2 of FIG. 1.

As shown in FIGS. 1A and 2, neck apparatus 10 includes an elongate base 18 which is attached at one end to body 14 and tapers somewhat toward an opposite end which is attached to head 16. A longitudinal channel 20 is formed in and extends substantially the entire length of base 18. As illustrated most clearly in FIG. 2, channel 20 includes a substantially uniform cross-section and has a pair of substantially parallel opposite sides 22 and 24. Channel 20 is filled with an acoustically inert filler 25 which intimately bonds to the walls of channel 20 and which eventually hardens to provide a rigid massive neck 10.

An elongate metal adjusting rod 30 is disposed within channel 20, either before or after filler 25 is introduced, but in any case before the filler hardens. Rod 30 is suspended in the filler generally centrally within channel 20. One end of rod 30 is threaded for receiving a pair of hex nuts 32 which are fixed in place on the rod by a liquid glue or cement such as Loktite TM or simply by the hardened filler 25. Alternatively, as observed in FIG. 1B the upper end of rod 30 may be formed into a flange 31 which is embedded in filler 25. The opposite end of rod 30 extends into lower channel portion 27 and therein includes threads for engaging an adjusting mechanism 34 which is described more fully in connection with FIG. 5 below.

Figure 3:
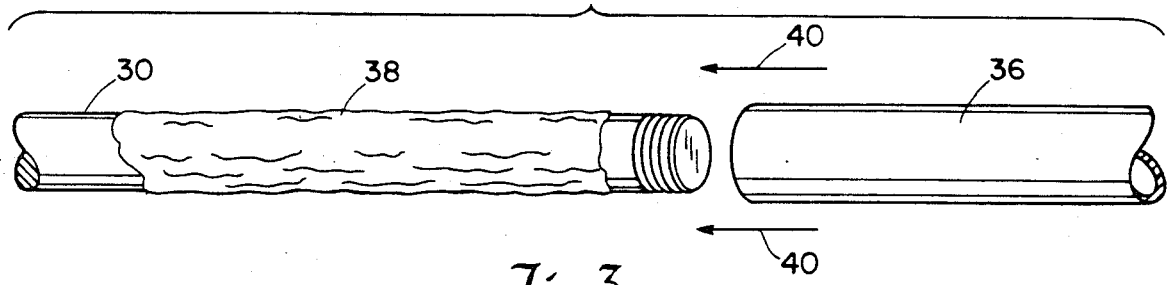
FIG. 3 is an axonometric view illustrating insertion of the rod into an accommodating sleeve.
Figure 4:
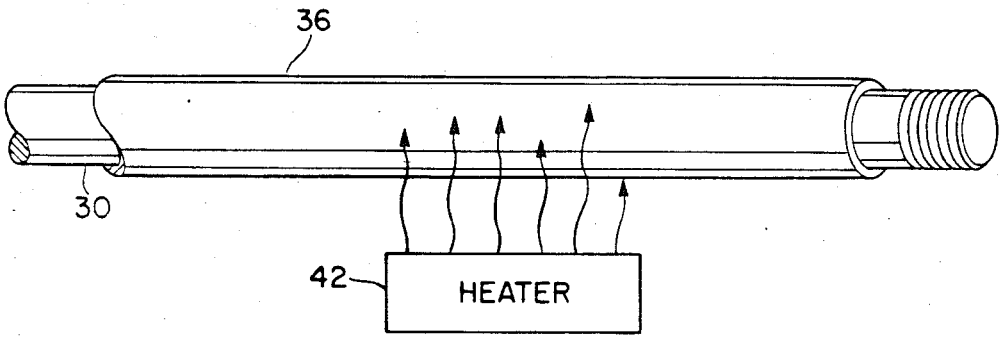
FIG. 4 is an axonometric view of the sleeve being heat shrunk into intimate contact with the rod.

An elastomeric sleeve 36 is wrapped tightly about rod 30 and extends generally axially in channel 20 above lower portion 27. As shown in FIG. 3, a lubricant 38 is applied to the surface of rod 30, or alternatively to the inside surface of sleeve 36 so that rod 30 is able to slide longitudinally within sleeve 36 with a minimum of friction. The sleeve is then fit onto the rod in the direction of arrows 40 and is heated such as by heater 42, FIG. 4, so that it is heat shrunk into intimate contact with rod 30.

Rod 30 and sleeve 36 are then disposed centrally within channel 20 and suspended in acoustically inert filler 25. When filler 25 hardens it provides guitar 12 with a massive and rigid neck. For example, the filler possesses a Q factor which is very low relative to the base. As a result, vibrations of strings 19, which have a much higher Q factor, are not dissipated into filler 25 and prematurely lost. Moreover, after it has hardened the filler possesses a hardness of at least 80 but no greater than 90; a tensile strength from 3600 to 6000 and a flexural strength between 5600 and 8500. This range enables the neck to exhibit enhanced and uniform strength and uniform bending and, at the same time, permits some adjustment of the neck.

Figure 5:
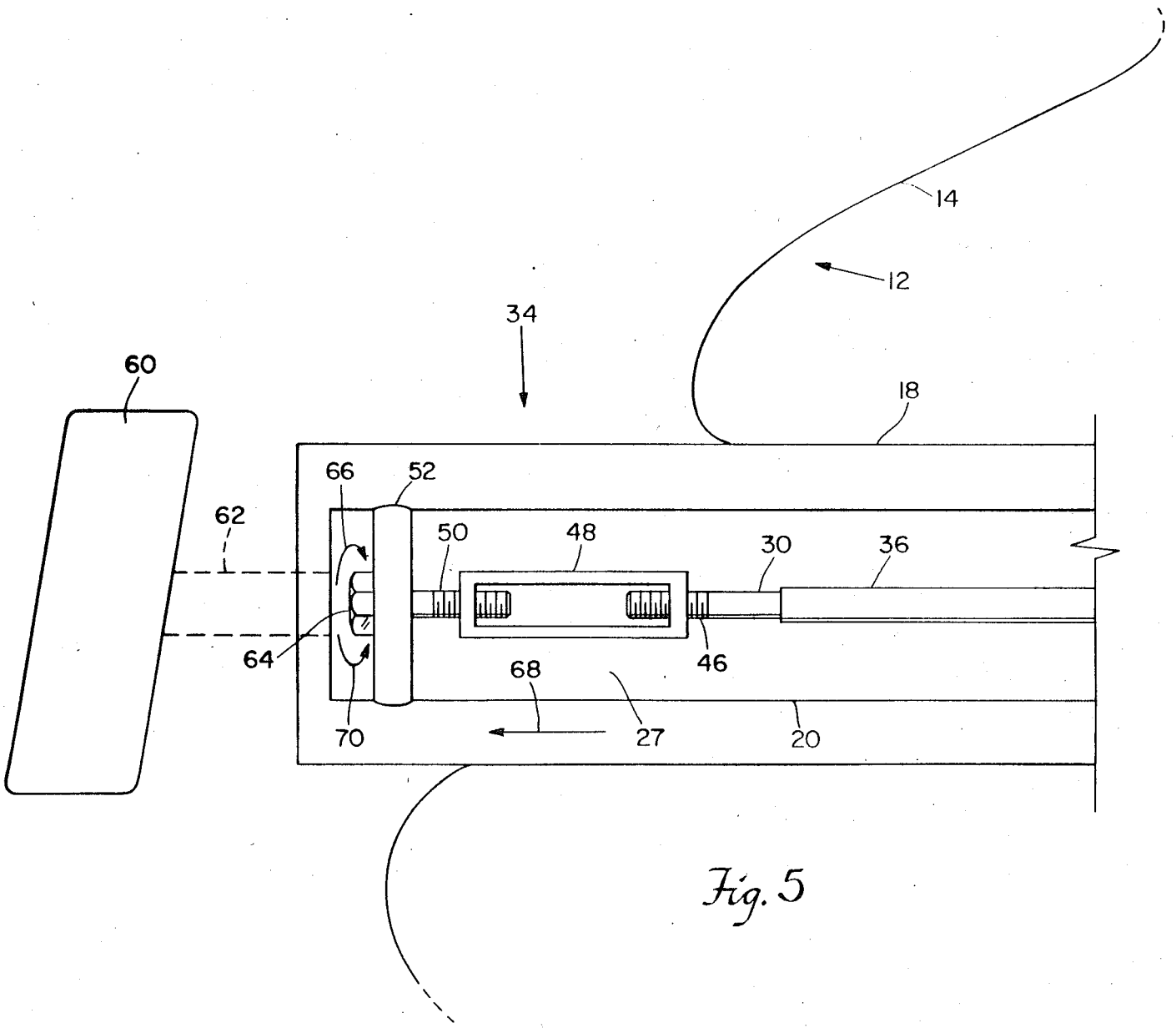
FIG. 5 is a top view of a portion of the neck proximate the body of the guitar with the fret board and strings removed, showing a mechanism for adjusting the longitudinal tension of the rod.

Such adjustment is provided as shown in FIG. 5 by rod 30 and adjustment mechanism 34. The threaded end 46 of rod 30 extends into lower channel portion 27 and therein is threadably received by a turnbuckle 48. The opposite end of turnbuckle 48 includes an adjusting hex screw 50. A retainer 52 mounted proximate the lower end of channel 20 rotatably supports screw 50 and prevents it from moving longitudinally within channel 20. The filler is introduced into channel 20 longitudinally above the lower end of sleeve 36. Below that point, e.g., within channel portion 27, the channel is temporarily packed with clay or a similar non-hardening compound during bonding so that no compound enters portion 27. After the filler hardens in the channel the clay is removed leaving recess 27 free and permitting longitudinal movement of turnbuckle 48 within portion 27.

As the guitar is being used the musician typically keeps it in tune by adjusting the string tension using the adjusting knobs in the head of the instrument. This may cause the neck to bow slightly, e.g., the head is pulled forward slightly in the direction of arrow 51, FIG. 1A. To compensate for this bowing and straighten the neck the musician utilizes adjusting mechanism 34, FIG. 5. The guitar pickup is removed and a hex wrench is introduced through pickup hole 60 and through a channel 62 in guitar body 14 to engage the head 64 of hex screw 50. The hex screw is turned in the direction of arrow 66 to draw turnbuckle 48 in the direction of arrow 68. Turnbuckle 48 in turn pulls rod 30 and because the upper end of rod 30 is fixed by hex nuts 32 the longitudinal tension exerted on the rod is increased. As it is being pulled rod 30 is able to slide slightly through sleeve 36 due to the lubricant between them. The sleeve is prevented from moving by the hardened filler. Increasing the longitudinal tension on the rod returns the neck to a straightened condition.

As the guitar's strings are loosened and the compensation of adjusting rod 30 is no longer needed the longitudinal tension on the rod may likewise be loosened by simply rotating hex screw 50 in the direction of arrow 70. This reduces the pull of turnbuckle 48 on rod 30 and as a result the longitudinal tension on the rod is reduced.

Figure 6:
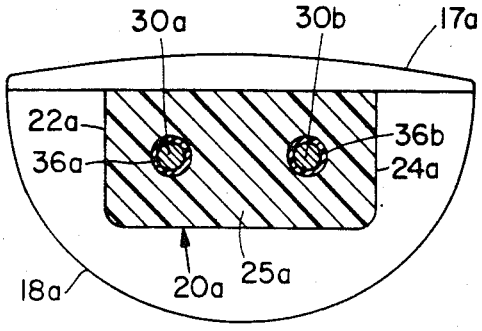
FIG. 6 is a cross-sectional view of an alternative neck according to this invention which employs two rods.

As shown in FIG. 6, fine tuning may also be provided by utilizing a pair of rods **30*a* and 30*b*, each suspended within filler 25*a* in channel 20*a*. Each of the rods is provided with its own sleeve 36*a*, 36*b* and the neck apparatus is completed by filling channel 20*a* with the previously described filler 25*a*. When the filler has hardened a fretboard 17*a* is mounted over base 18*a* and filler 25*a***.

Although a channel having uniform sectional sides is typically employed, the size of the channel relative to the base may be varied to accommodate various musical instruments. For example, whereas a channel, for example 25 mm. wide, is desirable for use in a lead guitar, a significantly larger channel, e.g., 32 mm. in width is desirable for use in a bass guitar. Such a larger channel enables more of the dense, acoustically inert filler material to be employed and thus provides the bass guitar with an even lower Q factor. As a result, the neck apparatus largely eliminates dead spots, particularly at such low frequencies.

Figure 7:
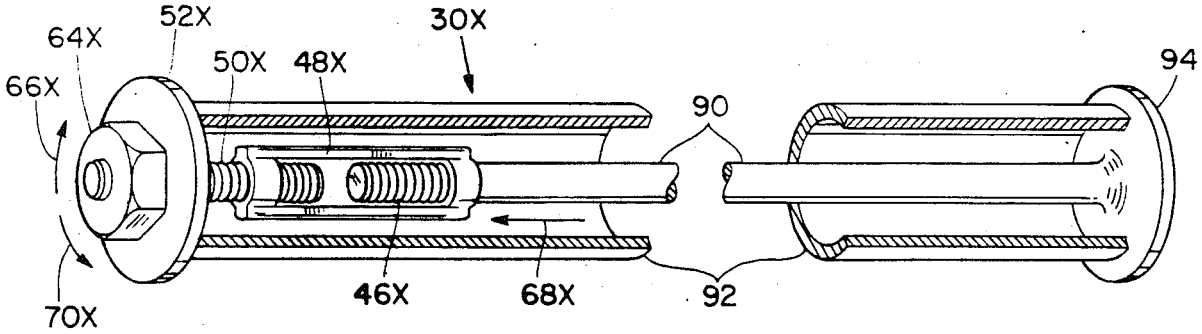
FIG. 7 is a partial cut-away axonometric view of an alternative preferred rod assembly which includes a rod element within a tube.

In an alternative preferred embodiment of this invention a rod assembly **30*x*, FIG. 7, may be substituted for rod 30. Rod assembly 30*x* includes an elongate rod element 90 which extends axially through an elongate metal tube 92. The upper end of element 90 terminates in a cap 94 which engages the upper end of tube 92. The opposite end of tube 92 engages a retaining element 52*x* which rotatably supports an adjusting hex screw 64*x*. The hex screw includes threads 50*x* which, along with threads 46*x* at the lower end of rod element 90 engage a turnbuckle 48*x***.

Figure 8:
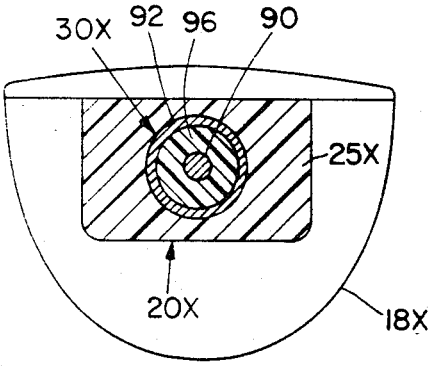
FIG. 8 is a cross-sectional view of the rod asembly of FIG. 7 suspended in the inert guitar neck filler.

As shown in FIG. 8, assembly **30*x* is suspended centrally in filler 25*x* within channel 20*x*. The filler extends up to retaining element 52*x*. A layer of plastic or rubber 96 may be wrapped about rod element 90 to cushion engagement between the rod and tube and reduce rattling. An elastomeric sleeve, not shown, as previously described, may also be wrapped about the outside of tube 92**.

Rod assembly **30*x* is tightened to compensate for tightened strings simply by rotating hex screw 64*x* in the direction of arrow 66*x*. This causes turnbuckle 48*x* to pull rod element 90 in the direction of arrow 68X thereby increasing tension on element 90. At the same time cap 94 is urged against and stresses tube 92. The rod element and tube are loosened simply by untightening hex screw 64*x*** *in the direction of arrow 70x.*

Figure 9:
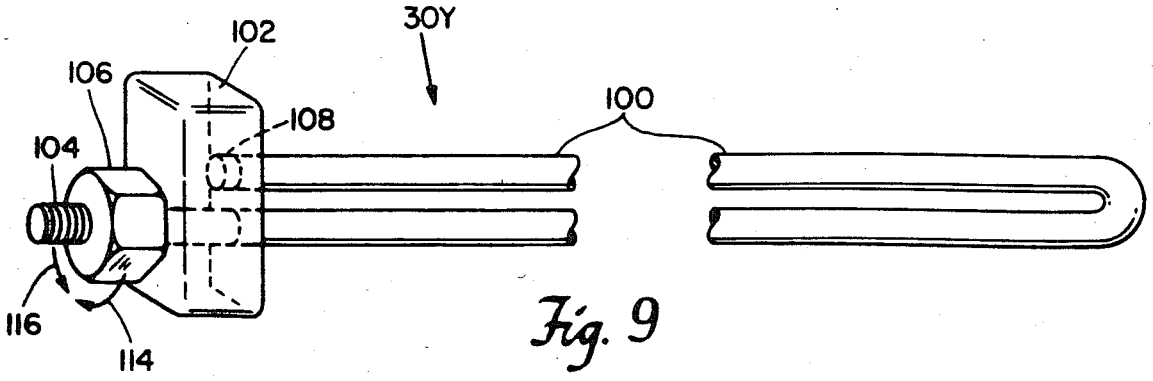
FIG. 9 is a partial axonometric view of a further alternative rod assembly.

A double reverse rod assembly **30*y*, FIG. 9, includes a U-shaped rod element 100 mounted in a support 102 and having a threaded upper end 104 which accommodates a hex nut 106. The opposite end of rod element 100 is received in a recess 108 in the bottom of support 102**.

Figure 10:
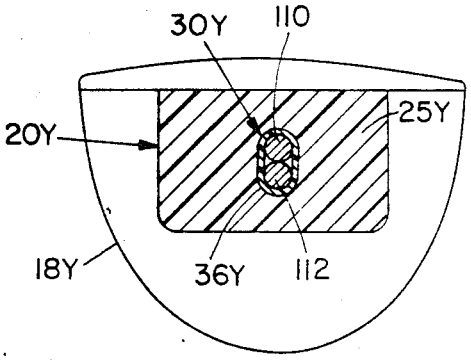
FIG. 10 is a cross-sectional view of the rod assembly of FIG. 9 suspended in the inert guitar neck filler.

Rod assembly **30*y* is suspended in filler 25*y* in the guitar neck channel as shown in FIG. 10, so that one leg 110 of element 100 is located above the other leg 112. A plastic or rubber sleeve 36*y* is wrapped about rod element 100 to facilitate longitudinal tensioning and loosening of the rod element within the hardened filler 25*y*** and to reduce rattling.

The rod element is tightened and loosened to counteract variable string tension by turning hex nut in the direction of arrows 114 and 116, respectively.

Although specific features of the invention are shown in some drawings and not others this is for convenience only as each feature may be combined with any or all of the other features in accordance with the invention.

Other embodiments will occur to those skilled in the art and are within the following claims.

What is claimed is:

1. An improved neck apparatus for stringed musical instruments comprising:

an elongate base;

a longitudinal channel disposed in said base;

an acoustically inert filler disposed in and intimately bonded to the inside surface of at least a portion of said channel; and at least one elongate rod assembly suspended in said filler in said channel.

2. The neck apparatus of claim 1 in which said at least one elongate rod assembly extends generally centrally through said channel.

3. The neck apparatus of claim 2 further including means for adjusting the longitudinal tension of said at least one rod assembly within said channel.

4. The neck apparatus of claim 3 in which said means for adjusting is disposed proximate one end of said channel and attached at one end of said rod, the opposite end of said rod being fixed within said channel.

5. The neck apparatus of claim 2 further including at least one sleeve disposed in said channel for slidably receiving a respective said rod assembly.

6. The neck apparatus of claim 5 further including a lubricant disposed between said sleeve and said rod assembly for reducing the friction therebetween.

7. The neck apparatus of claim 1 in which said rod assembly includes an elongate rod element.

8. The neck apparatus of claim 7 in which said rod assembly includes an elongate tube for receiving said rod element.

9. The neck apparatus of claim 8 further including means disposed axially between said rod element and said tube for cushioning engagement therebetween.

10. The neck apparatus of claim 1 in which said channel includes a substantially uniform cross section.

11. The neck apparatus of claim 1 in which said channel includes a pair of substantially parallel opposite sides.

12. The neck apparatus of claim 1 in which said filler is composed of a material having a hardness (Shore D ASTM D1706 psi) of at least 80 but no greater than 90.

13. The neck apparatus of claim 1 in which said filler is composed of a material having a tensile strength (ASTM D638 psi) of at least 3600 but no greater than 6000.

14. The neck apparatus of claim 1 in which said filler is composed of a material having a flexural strength (ASTM D790 psi) of at least 5600 but no greater than 8500.

15. The neck apparatus of claim 1 in which said rod assembly further includes a pair of elongate rods disposed in said channel.

16. The neck apparatus of claim 1 in which said base is composed of wood.

17. The neck apparatus of claim 1 in which said base is composed of urethane.

18. The neck apparatus of claim 1 in which said channel has a volume that comprises more than one half the volume of said base.

19. An improved neck apparatus for stringed instruments comprising:

an elongate base;

a longitudinal channel disposed in said base;

an acoustically inert filler disposed in and intimately bonded to the inside surface of at least a portion of said channel;

an elongate rod assembly suspended in said filler; and means for adjusting the longitudinal tension of said rod assembly within said channel.

20. A method of making a neck apparatus for stringed musical instruments comprising:

forming a longitudinal channel in an elongate base;

filling at least a portion of said channel with an acoustically inert filler;

suspending a rod assembly in said filler; and allowing said filler to harden and bond intimately to the inside surface of said channel while said rod assembly is suspended in said filter.

21. The method of claim 20 further including inserting at least one said rod element in a tube to form said rod assembly.

22. The method of claim 20 further including inserting at least one rod element in an elastomeric sleeve to form said rod assembly, and heat shrinking the sleeve into intimate engagement with said rod.

23. The method of claim 22 further including applying a lubricant to at least one of said rod element and the inside of the sleeve before the rod element is inserted.

* * * * *